US009273939B2

(12) United States Patent
Ackermann

(10) Patent No.: US 9,273,939 B2
(45) Date of Patent: Mar. 1, 2016

(54) IGNITION SYSTEM FOR SCALABLE MUNITIONS SYSTEM

(71) Applicant: TDW Gesellschaft fuer verteidigungstechnische Wirksysteme mbH, Schrobenhausen (DE)

(72) Inventor: Hans-Dieter Ackermann, Schrobenhausen (DE)

(73) Assignee: TDW Gesellschaft fuer verteidigungstechnische Wirksysteme mbH, Schrobenhausen (DE)

( * ) Notice: Subject to any disclaimer, the term of this patent is extended or adjusted under 35 U.S.C. 154(b) by 0 days.

(21) Appl. No.: 14/661,432

(22) Filed: Mar. 18, 2015

(65) Prior Publication Data

US 2015/0345915 A1 Dec. 3, 2015

(30) Foreign Application Priority Data

Mar. 20, 2014 (DE) ..... 10 2014 004 003

(51) Int. Cl.
*F42B 1/00* (2006.01)
*F42B 3/10* (2006.01)

(52) U.S. Cl.
CPC .... *F42B 1/00* (2013.01); *F42B 3/10* (2013.01)

(58) Field of Classification Search
USPC ..... 102/305, 217, 202.6, 202.14, 206, 102/275.11, 481
See application file for complete search history.

(56) References Cited

U.S. PATENT DOCUMENTS

| | | | | |
|---|---|---|---|---|
| 4,815,385 | A | 3/1989 | Kingery et al. | |
| 8,371,224 | B1 * | 2/2013 | Boswell | F42C 19/0807 102/217 |
| 8,931,415 | B2 * | 1/2015 | Volkmann | F42B 3/16 102/217 |
| 2003/0164109 | A1 * | 9/2003 | Spivak | F42B 12/204 102/475 |
| 2010/0031841 | A1 * | 2/2010 | Michel | F42C 15/005 102/222 |

FOREIGN PATENT DOCUMENTS

| | | | |
|---|---|---|---|
| DE | 3918513 | C1 | 4/1990 |
| DE | 10008914 | C2 | 9/2001 |
| DE | 102009017160 | B3 | 8/2010 |
| DE | 102012006044 | B3 | 3/2013 |
| DE | 102013011404 | A1 | 1/2015 |

* cited by examiner

*Primary Examiner* — J. Woodrow Eldred

(74) *Attorney, Agent, or Firm* — Von Rohrscheidt Patents

(57) ABSTRACT

An ignition system for a munitions system which is scalable with respect to its power delivery and which includes two different ignition circuits for a sub-detonative and a detonative initiation of an explosive charge of the munitions system, wherein a control mechanism in a sub-detonative ignition circuit monitors function and thus prevents an uncontrolled complete power delivery of the munitions charge.

9 Claims, 2 Drawing Sheets

IGNITION SYSTEM FOR SCALABLE MUNITIONS SYSTEM

RELATED APPLICATIONS

This application claims priority from and incorporates by reference German Patent Application DE 10 2014 004 003.8 filed on Mar. 20, 2014.

FIELD OF THE INVENTION

The invention relates to an ignition system for a scalable munitions system which includes at least one explosive charge, wherein a first ignition device is provided for initiating a sub-detonation mechanism through which an explosive charge is excitable to perform a deflagration, wherein a second ignition device is provided to perform a detonative initiation of the explosive charge, and wherein the ignition devices can be triggered independently from one another with a control unit and both ignition devices are arranged directly adjacent to one another.

BACKGROUND OF THE INVENTION

An ignition system of this type is described in DE 10 2013 011 404 A1. Herein it is proposed to combine the initiation locations for the deflagrative initiation and the detonative initiation of the munitions system in one place. Both ignition devices can be triggered shortly one after another wherein the time delay directly influences power scaling of the explosive charge. However, the description of the ignition system of DE 10 2013 011 404 A1 does not state in which manner the two ignition devices shall be implemented.

DE 10 2012 006 044 B3 relates to a method for measuring a propagation of a detonation front which originates from a first ignition location and determines a suitable ignition point of a second ignition location arranged opposite to the first ignition location.

DE 39 18 513 C1 relates to a safety device for a double shape charge warhead which facilitates a time delayed ignition of the two shape charges.

U.S. Pat. No. 4,815,385 A illustrates an ignition device for an explosive charge which includes opposite ignition locations ignited simultaneously in order to cause a focused radial power release in a center of a cylindrical charge.

DE 10 2009 017 160 B3 describes a warhead with an explosive charge which includes one or more munitions charges at its face wherein the sub-charges have an exclusively deflagrative effect upon the explosive charge.

A warhead with a cylindrical explosive charge according to DE 100 08 918 C2 with two charges arranged opposite to one another wherein one charge initiates in a detonative manner and the other charge, however, initiates in a deflagrative manner is adjustable with respect to its power release in very wide limits.

None of the above recited prior art, however, is suitable, to solve the technical problems described infra.

BRIEF SUMMARY OR THE INVENTION

It is an object of the instant invention to provide an ignition system which is provided with two independent ignition devices and which is capable to safety prevent a detonative initiation in case a deflagrative initiation fails.

An object of the instant invention is achieved according to the invention by arranging a detonation sensor for detecting a normal function of an initiation of a detonation or a failure of the initiation of the detonation in a portion of an output of the first ignition device at the sub-detonation mechanism corresponding therewith, wherein an output signal of the detonation sensor is connected with a connection for releasing or blocking the second detonation device directly impacting the explosive charge.

An ignition system of this type detects an actual initiation of the sub-detonation mechanism which in turn causes the deflagration of the explosive charge. In case of a malfunction of the first ignition device, the initiation of the explosive charge is prevented in a timely manner so that a complete detonation of the explosive charge is precluded.

Advantageous embodiments of the ignition system of the instant invention can be derived from the claims and the detailed description.

BRIEF DESCRIPTION OF THE DRAWINGS

The invention is subsequently described in more detail with reference to figures, wherein.

DETAILED DESCRIPTION OF THE INVENTION

It is appreciated that a munitions system is for example a warhead which includes at least one explosive charge which can be initiated in different ways by at least two different ignition devices which renders power delivery of the warhead adjustable in a wide range.

The invention is based on the finding that an ignition of scalable munitions systems by two ignition devices arranged on a longitudinal axis of the munitions system can cause problems at least when the ignition device which is configured to initiate the deflagration of the explosive charge is destroyed for example upon target impact and the munitions system subsequently detonates almost with full power.

This sparked the idea to develop a munitions system with two ignition devices arranged directly adjacent to one another, wherein scalable power delivery shall be possible without preconceived limits.

According to this concept, a first ignition device initially starts a sub-detonative conversion of the explosive material until a detonative initiation is initiated by a second ignition device with some time delay thereafter.

For several reasons it is preferred that the initiations are performed at the same location and that a front of the sub-detonation propagates with almost the same speed as the subsequent detonation front. The scalable power delivery is then adjusted by the delay time between the sub-detonation and the detonation.

Figure 1:
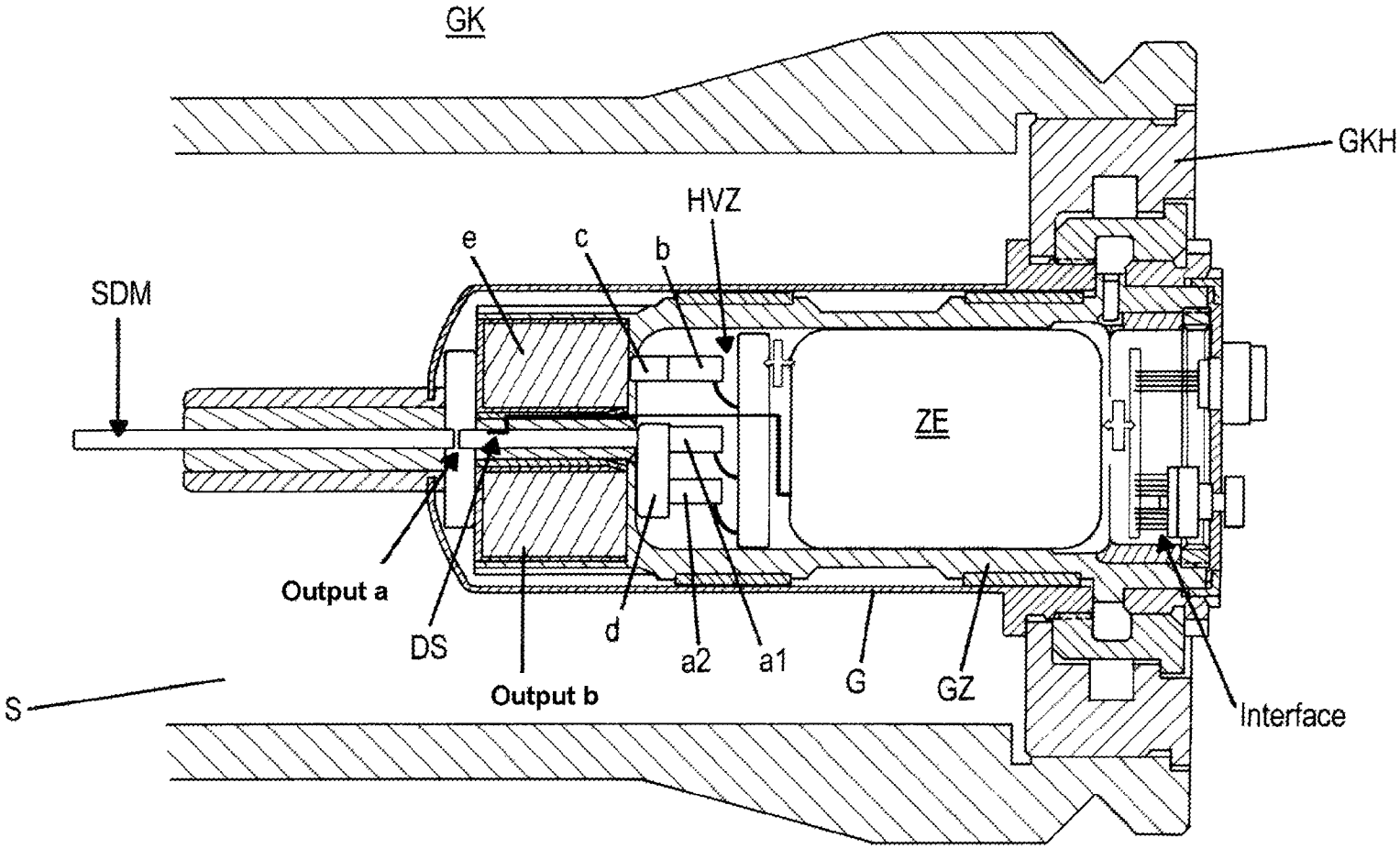
FIG. 1 illustrates a longitudinal sectional view of an ignition system according to the invention.

The basic principle of the instant ignition system is independent from a geometry of the munitions system. The exemplary ignition system illustrated in FIG. 1 corresponds structurally to the standard three inch Air Force and Navy ignition devices. Thus, it is apparent to install a munitions system of this type in standardized munitions systems GK taking their manufacturing process into consideration. Introducing the detonation into the explosive charge S is then performed by the explosive booster which initiates the surrounding explosive material S of the main charge laterally by the "side light" method through the wall G. The ignition system can be adapted in a simple manner to known munitions elements through appropriate sizing.

Installing the housing G of the ignition system is performed by a common threaded ring into a housing GKH of the munitions system GK. A volume and a position of the plug connector of a spiral cable that is typically arranged in an interior of the explosive charge are thus used for connecting the sub-detonation mechanism SDM to the ignition system. The connection is configured so that it closes in a self-aligning manner when the ignition system housing G is inserted.

Figure 2:
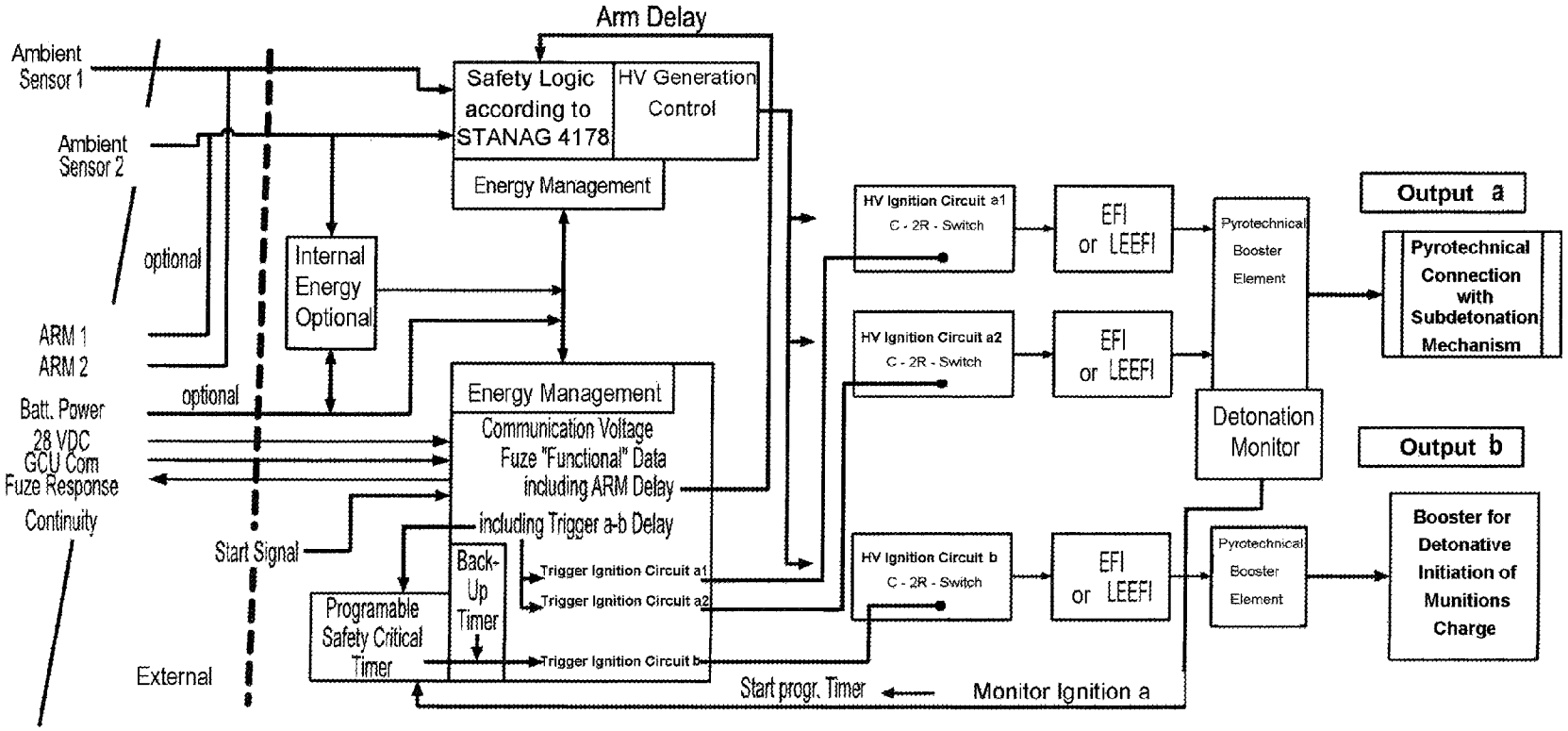
FIG. 2 illustrates a block diagram of the ignition system stating functions of individual elements.

FIG. 2 illustrates a block diagram of the ignition system in a schematically simplified manner. Arming either starts due to a decision by ARM1, ARM2 or based on the sensor of signals Sensor1, Sensor2 which respectively impacts safety logic. When the safety logic is provided with all signals for an intentional ignition the power supply HV generation and regulation for the ignition circuits is provided.

An important function in the safety logic suppresses an unintentional early ignition of the detonative output. It also includes a time function including a programmable safety critical timer which controls the ignition circuit b together with the function back up timer and thereby determines whether the detonative initiation of the munitions charge is performed as a function of the output signal of the detonation monitor or not.

During normal operations the ignition circuits a1 and a2 are initiated and both ignition circuits impact the booster charge using detonators EFI (Exploding Foil Initiator) or LEEFI (Low Energy Exploding Foil Initiator) which ignite the transmitter booster elements which then triggers the sub-detonation mechanism.

Thus, the detonation monitor can be optionally arranged at the booster charge or also at the sub-detonation mechanism with the same effect.

When the detonation monitor provides a particular function to the programmable safety critical timer and also the ignition circuit b initiates after a time delay that is a function of the desired power of the munitions charge so that the booster for a detonative initiation of the munitions charge is ignited through a detonator EFI or LEEFI and an additional booster charge.

Turning the charge hot is performed as follows. Depending on the programming the ignition system receives a start signal either externally, for example from a ground proximity sensor or from a control of the missile, or the ignition system receives the start signal from an internal impact sensor. Using the programming, different conditions at the target location can be considered. Thus, the start signal can be provided either as quick detonation (instantaneous ignition), with a time delay or as a function of ambient conditions.

Typically the deflagration mechanism is then started by the ignition circuits a1, a2. The detonation monitor checks for correct operations and starts the programmed timer for initiating the detonative initiation through the trigger ignition circuit b. From there a regular ignition runs through another detonator EFI or LEEFI on an additional transmitter-booster element to the booster for the detonative initiation of the munitions charge. Should this path fail the detonative initiation of the explosive charge S will not occur.

Due to the two different paths of sub-detonative and/or detonative initiation it is assured that an undesired detonative initiation of the explosive charge S is excluded in any case.

The timer in the central control unit is safety critical since an early ignition leads to an undesired higher power delivery of the munitions system. This timer is provided according to the regulations of STANAG 4187. This configuration assures that the set delay for the permanent performance of the munitions system is not undercut with a high level of safety. The detonation monitor can be provided in various types. It can be a mechanical sensor or an optical sensor. By the same token coaxial cables, light conductors, or ionization sensors can be used.

What is claimed is:

1. An ignition system for a scalable munitions system, comprising:

at least one explosive charge, wherein a first ignition device is provided for initiating a sub-detonation mechanism by which the explosive charge is excitable to perform a deflagration, wherein a second ignition device is provided for a detonative initiation of the explosive charge, wherein the first and second ignition devices are triggerable independently from one another by a control unit and the first and second ignition devices are arranged directly adjacent to one another, wherein a detonation sensor for detecting a normal function of the initiation of the first ignition device or a failure of the initiation of the first ignition device is arranged in a portion of an outlet of the first ignition device and in a sub-detonation mechanism corresponding with the portion of the outlet of the first ignition device, wherein an output signal of the detonation sensor is connected with a connection for releasing or blocking the second ignition device directly impacting the explosive charge, and wherein the detonative initiation of the explosive charge is prevented if the first ignition device fails.

2. The ignition system according to claim 1, wherein the first ignition device is configured redundantly.

3. The ignition system according to claim 1, wherein the second ignition device is configured redundantly.

4. The ignition system according to claim 1, wherein the ignition system includes a central control unit.

5. The ignition system according to claim 4, wherein the control unit is provided with at least two ambient sensors.

6. The ignition system according to claim 5, wherein the control unit is connected with safety logic, wherein the safety logic is connected with the ignition release and ambient sensors, and wherein the safety logic blocks or releases ignition as a function of its input variables.

7. The ignition system according to claim 6, wherein the control unit is programmable.

8. The ignition system according to claim 6, wherein the safety logic include time based switching which controls additional functions as a function of input signals within a time window or at a defined point in time.

9. The ignition system according to claim 1, wherein the entire ignition system is arranged in a compact housing which is insertable into a mouth opening of the munitions system, and wherein required electrical connections to additional functional elements of the munitions systems are connectable in a self-aligning manner.

* * * * *